US011805862B2

(12) United States Patent
LeCompte et al.

(10) Patent No.: US 11,805,862 B2
(45) Date of Patent: Nov. 7, 2023

(54) BUTTON ASSEMBLED WITH REMOVABLE SCREW AND METHOD OF ATTACHING REMOVABLE SCREW

(71) Applicant: YKK Corporation, Tokyo (JP)

(72) Inventors: Chuck G. LeCompte, Frankfort, KY (US); Jonathan H. Sharp, Lawrenceburg, KY (US); Hidetsugu Tanaka, Lawrenceburg, KY (US)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 17/224,437

(22) Filed: Apr. 7, 2021

(65) Prior Publication Data

US 2021/0315325 A1 Oct. 14, 2021

Related U.S. Application Data

(60) Provisional application No. 63/007,177, filed on Apr. 8, 2020.

(51) Int. Cl.

| | |
|---|---|
| ***A44B 1/30*** | (2006.01) |
| ***A44B 1/08*** | (2006.01) |
| ***A44B 1/06*** | (2006.01) |
| ***A41H 37/00*** | (2006.01) |

(52) U.S. Cl.

CPC ..... *A44B 1/08* (2013.01); *A41H 37/001* (2013.01); *A44B 1/06* (2013.01); *A44B 1/30* (2013.01)

(58) Field of Classification Search

CPC .... A44B 1/06; A44B 1/30; A44B 1/08; A41H 37/001

See application file for complete search history.

(56) References Cited

U.S. PATENT DOCUMENTS

| | | | | |
|---|---|---|---|---|
| 3,474,504 A * | 10/1969 | Holdsworth | ..... | A44B 1/30 24/114.4 |
| 5,426,828 A * | 6/1995 | Kusano | ..... | A44B 1/30 24/111 |
| 7,251,865 B2 * | 8/2007 | Takamura | ..... | A44B 1/34 24/691 |
| 10,925,352 B2 * | 2/2021 | LeCompte | ..... | A44B 1/08 |
| 2006/0162133 A1 | 7/2006 | Takamura et al. | | |

(Continued)

FOREIGN PATENT DOCUMENTS

| | | |
|---|---|---|
| CN | 1671312 A | 9/2005 |
| CN | 101028144 A | 9/2007 |

(Continued)

OTHER PUBLICATIONS

Office Action, Chinese Patent Application No. 202110379427.7, dated Apr. 29, 2022, 20 pages.

*Primary Examiner* — Robert Sandy
*Assistant Examiner* — Michael S Lee
(74) *Attorney, Agent, or Firm* — Kilpatrick Townsend & Stockton LLP

(57) ABSTRACT

A button assembly that includes a button and a removable screw is provided. A method of attaching a button to a garment is provided. The method includes a step of placing a portion of the garment between the button and a removable screw, a step of penetrating the portion of the garment with the removable screw such that the removable screw is engaged with the garment, and a step of engaging the removable screw with the button.

5 Claims, 9 Drawing Sheets

(56) References Cited

U.S. PATENT DOCUMENTS

| | | | | |
|---|---|---|---|---|
| 2008/0289076 | A1* | 11/2008 | Millward | A44B 1/30 2/265 |
| 2014/0187063 | A1 | 7/2014 | Selby et al. | |
| 2014/0187899 | A1 | 7/2014 | Pernu et al. | |
| 2014/0187900 | A1 | 7/2014 | Pernu et al. | |
| 2017/0265767 | A1 | 9/2017 | Pernu et al. | |
| 2020/0093390 | A1 | 3/2020 | Pernu et al. | |

FOREIGN PATENT DOCUMENTS

| | | | | |
|---|---|---|---|---|
| CN | 201379155 | Y | 1/2010 | |
| CN | 104095330 | A | 10/2014 | |
| CN | 104739398 | A | 7/2015 | |
| EP | 1541050 | A1 * | 6/2005 | A44B 1/08 |

* cited by examiner

BUTTON ASSEMBLED WITH REMOVABLE SCREW AND METHOD OF ATTACHING REMOVABLE SCREW

BACKGROUND

The present invention is related to a button assembled with a removable screw, and a method of attaching a removable screw. Especially, the present invention is related to a button that is assembled with a removable screw and can be removed from a garment and a method of attaching the button to the garment using the removable screw.

SUMMARY

A button in a related art used for garments such as denim jeans or pants is attached to a garment fixedly using a tack, and cannot be removed from the garment. If a button can be removed from a garment, the garment can be recyclable or completely biodegradable in some cases, which contributes to the protection of the environment.

According to an advantageous aspect of the present invention, there is provided a button assembly including a button and a removable screw.

According to another advantageous aspect of the present invention, there is provided a method of attaching a button to a garment, the method including: placing a portion of the garment between the button and a removable screw; penetrating the portion of the garment with the removable screw such that the removable screw is engaged with the garment; and engaging the removable screw with the button.

The method of attaching a removable screw according to the present invention includes a first step of preparing a button that includes a plate portion and a post portion erecting from the plate portion of the button and has no convexo-concave surface in a cavity provided in the post portion of the button and a screw that includes a plate portion and a post portion erecting from the plate portion of the screw and has screw threads on an outer surface of the post portion of the screw, and a second step of placing fabric between the button and the screw, tucking the post portion of the screw into the cavity of the button to allow the post portion of the screw to pass through the fabric, attaching the screw to the button, and forming the convexo-concave surface corresponding to a shape of the screw threads on the outer surface of the post portion of the screw in the cavity of the button.

In the method of attaching the removable screw according to the present invention, in the second step, when the post portion of the screw is tucked into the cavity of the button, the screw is pushed without being rotated.

In the method of attaching a removable screw according to the present invention, in the second step, after the screw is attached to the button, the button and the screw can be removed from the fabric by rotating at least one of the button and the screw.

In the method of attaching a removable screw according to the present invention, in the first step, the post portion of the button is formed of a material softer than a material of the post portion of the screw.

In the method of attaching a removable screw according to the present invention, in the first step, the button includes an insert portion, an outer portion and a cap, the insert portion includes the plate portion of the button and the post portion of the button that are formed of a resin, the outer portion covers an outer side of the insert portion and is formed of a metal, and the cap covers the insert portion and the outer portion and is formed of a metal.

DETAILED DESCRIPTION OF EXEMPLIFIED EMBODIMENTS

Figure 1:
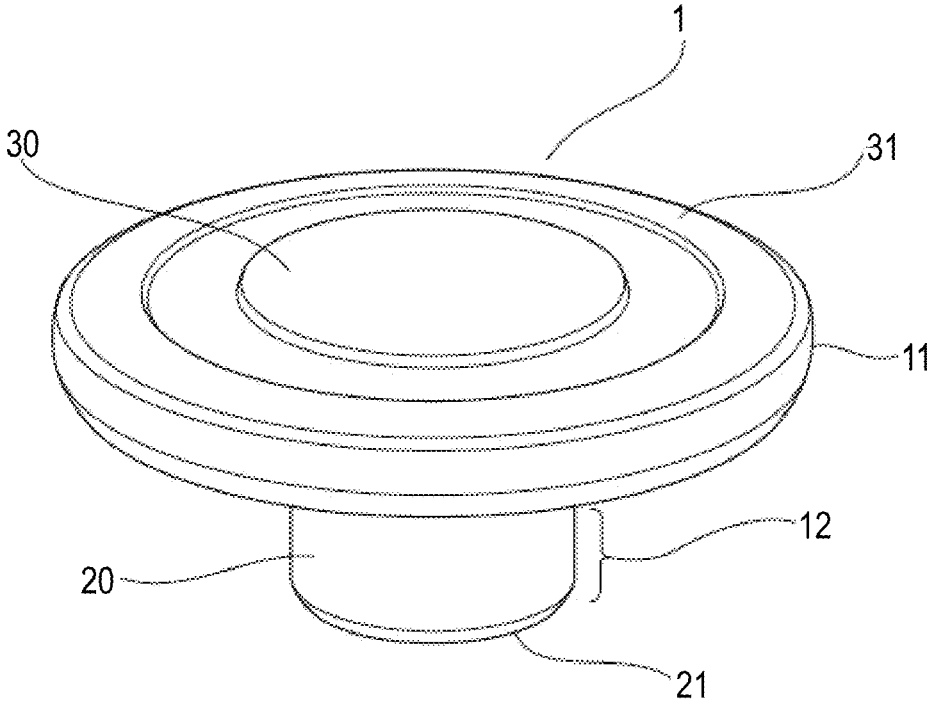
FIG. 1 is an upper perspective view of a button to be assembled with a removable screw in accordance with an embodiment.
Figure 2:
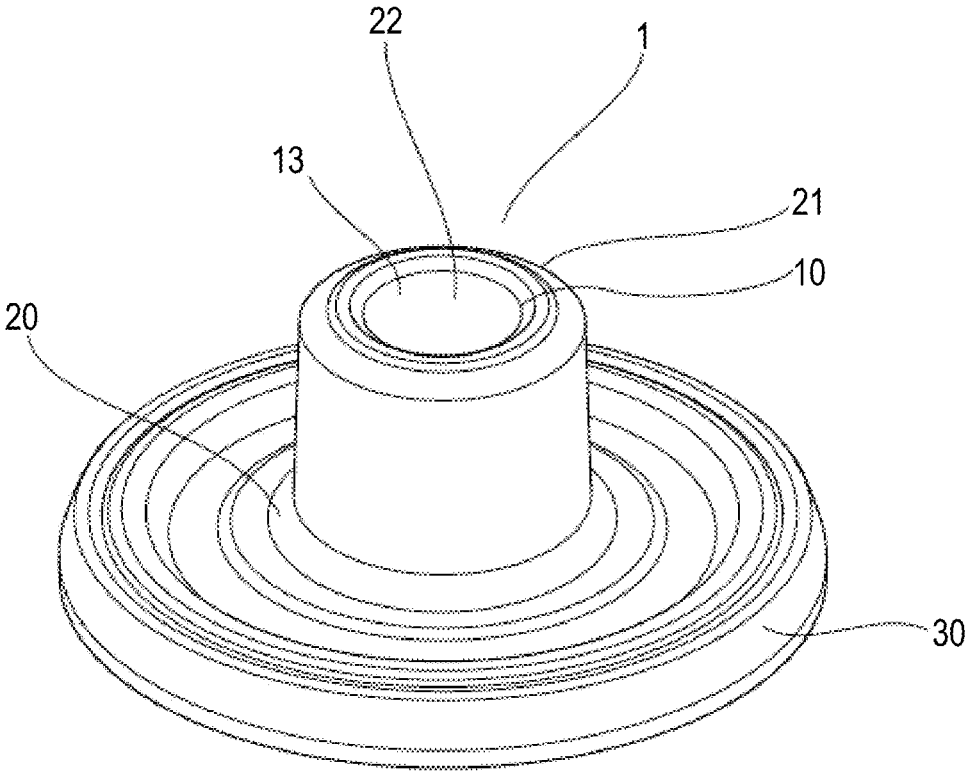
FIG. 2 is a lower perspective view of the button to be assembled with the removable screw shown in FIG. 1.
Figure 3:
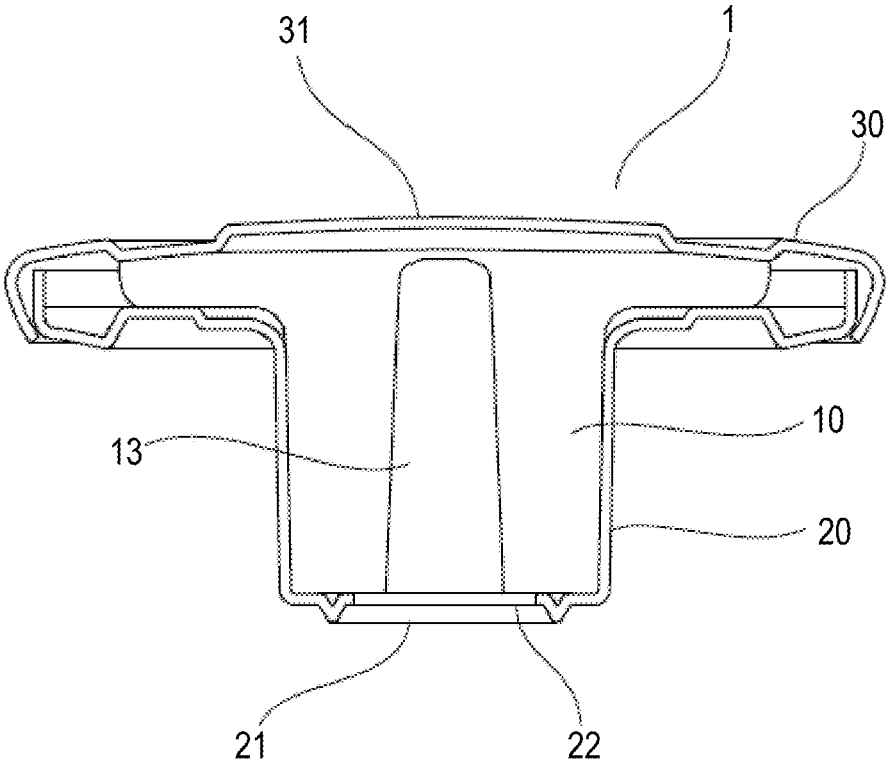
FIG. 3 is a cross sectional view of the button to be assembled with the removable screw shown in FIG. 1.

FIGS. 1 to 3 show various views of a button 1 to be assembled with a removable screw 40. As shown in FIGS. 1 to 3, the button 1 includes a plate portion 11, a post portion 12 erecting from the plate portion 11, an insert portion 10 including the plate portion 11 and the post portion 12, an outer portion 20 surrounding an outer side of the insert portion 10 and having a bottom surface 21, and a cap 30 covering the insert portion 10 and the outer portion 20 and including a top surface 31 which is at the opposite end of the bottom surface 21. The bottom surface 21 defines an opening 22. The post portion 12 of the insert portion 10 has an inner wall extending from the bottom surface 21 toward the cap 30, and a cavity 13 is formed in the post portion 12 by the inner wall. The cavity 13 shown in FIG. 3 is tapered. Alternatively, the cavity 13 may have a straight shape or any suitable shape to receive a removable screw 40. The cavity 13 is formed such that the cavity 13 is narrowed from an end portion of the post portion 12 toward an inner side of the cavity 13 (toward the plate portion 11). More specifically, the cavity 13 has a substantially cylindrical shape. A diameter of the cavity 13 is reduced from the end portion of the post portion 12 toward the inner side of the cavity 13. The post portion 12 has an inner wall without convexo-concave surface. The cavity 13 is formed in the post portion 12 by the plat inner wall. The cap 30 and the outer portion 30 of the button 1 are formed of, for example, a metal, and may be formed of any other suitable materials. The insert portion 10 is formed of, for example, a resin, and may be formed of any material softer than a material of a post portion 42 of the removable screw 40. The button 1 includes the insert portion 10 formed of a resin and provided with the plate portion 11 and the post portion 12, the outer portion 20 that covers an outer side of the insert portion 10 and is formed of a metal, and the cap 30 that covers the insert portion 10 and the outer portion 20 and is formed of a metal, so that convexo-concave surface corresponding to a shape of screw threads 44 can be formed in the cavity 13 of the post portion 12 while ensuring strength of the button 1. The insert portion 10 is formed of a material softer than the material of the post portion 42 of the screw 40, so that convexo-concave surface corresponding to the shape of the screw threads 44 on an outer surface 43 of the post portion 42 of the screw 40 can be reliably formed on a side surface of the inner wall of the cavity 13 of the button 1.

Figure 4:
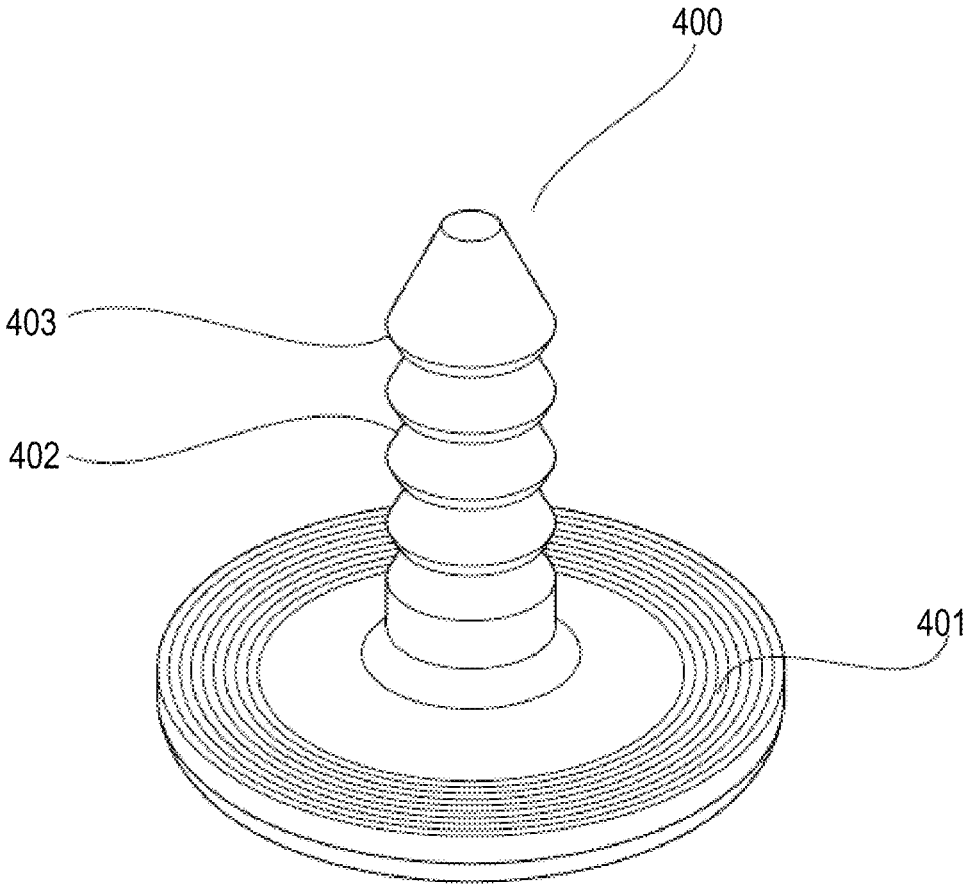
FIG. 4 is a perspective view of a tack in the related art that is used to attach a button to a garment fixedly.

FIG. 4 shows a tack 400 in a related art that is used to attach a button to a garment fixedly. The tack 400 has a plurality of locking ribs 403 along a post portion 402 erecting from a plate portion 401 and the locking ribs 403 engage with the button when the tack 400 is assembled with the button. The locking ribs 403 fixedly attach the tack 400 to the button, so that the locking ribs 403 cannot be removed once the locking ribs 403 are assembled with the button. For example, the tack 400 and the button are not disengaged even when the tack 400 is rotated.

Figure 5:
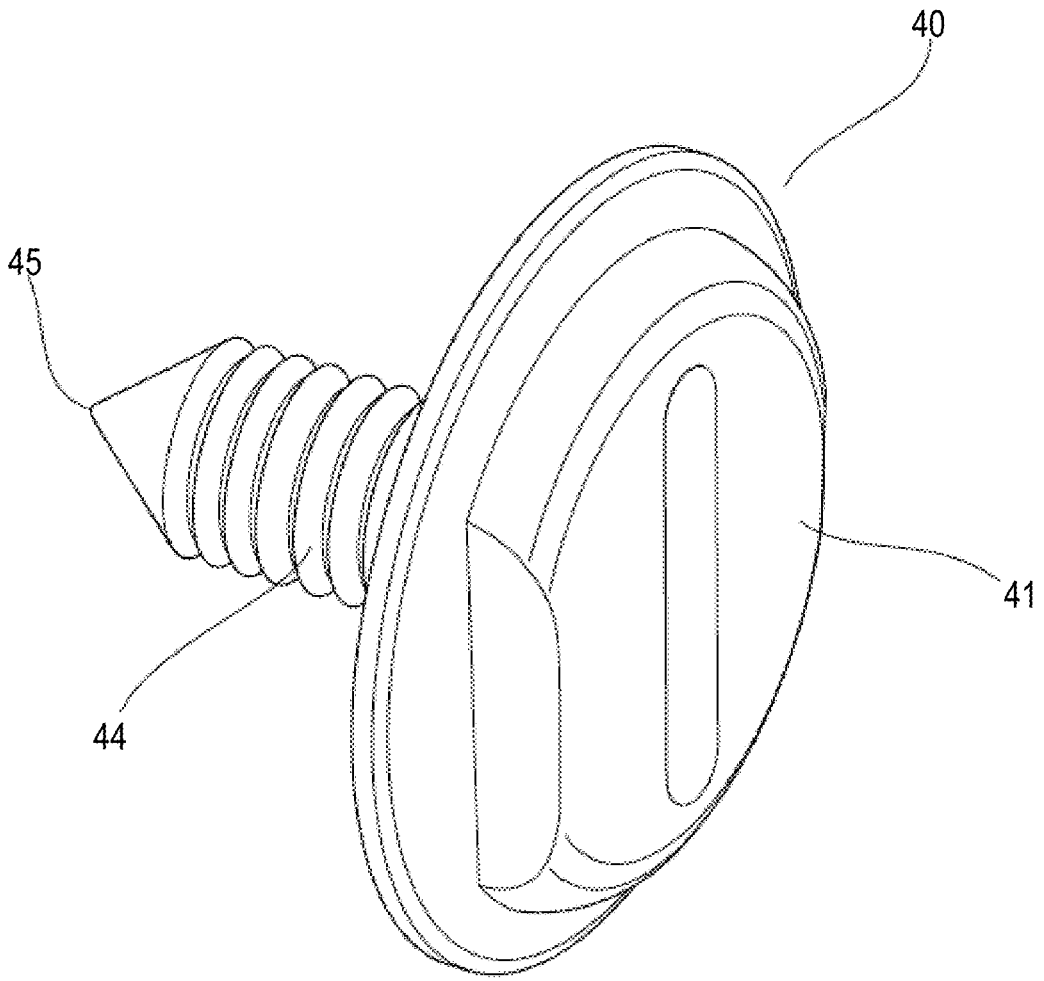
FIG. 5 is a perspective view of the removable screw in accordance with the embodiment.
Figure 6:
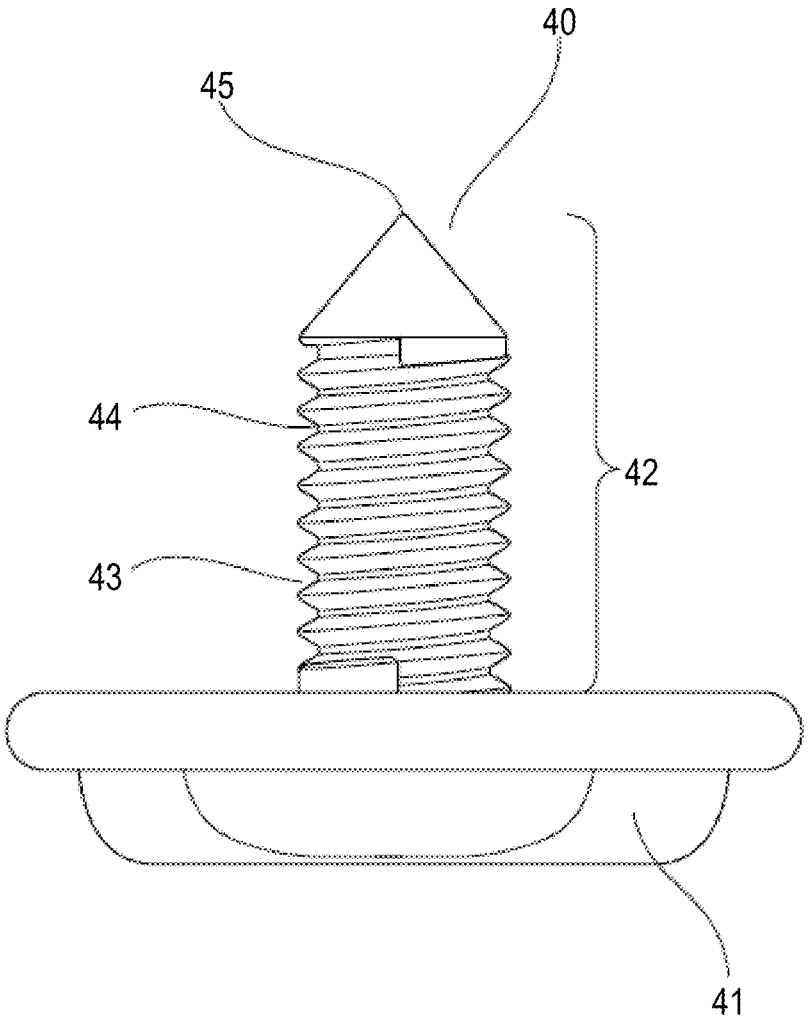
FIG. 6 is a side view of the removable screw shown in FIG. 5.

FIGS. 5 and 6 show the removable screw 40. The removable screw 40 includes a plate portion 41 and a post portion 42 erecting from the plate portion 41. The post portion 42 has the screw threads 44 on the outer surface 43 and has a leading end 45 at an edge. The plate portion 41 is provided at an opposite end from the leading end 45. The leading end 45 is designed to be sharp. In some cases, an angle of the leading end 45 is about 40 to 55 degrees. Alternatively, the angle of the leading end 45 may be set to any angle. A diameter of the screw thread 44 is approximately equal to a diameter of the cavity 13 of the button 1, and the screw threads 44 are in interference with the cavity 13. As a result, it is less likely to split the insert portion 10 when the screw 40 is attached to the button 1. When the screw thread 44 is too large, the insert portion 10 will fracture and lose attachment strength between the screw 40 and the button 1. The removable screw 40 is formed of, for example, a metal, and may be formed of any suitable material that is more rigid than the insert portion 10 of the button 1.

Figure 7:
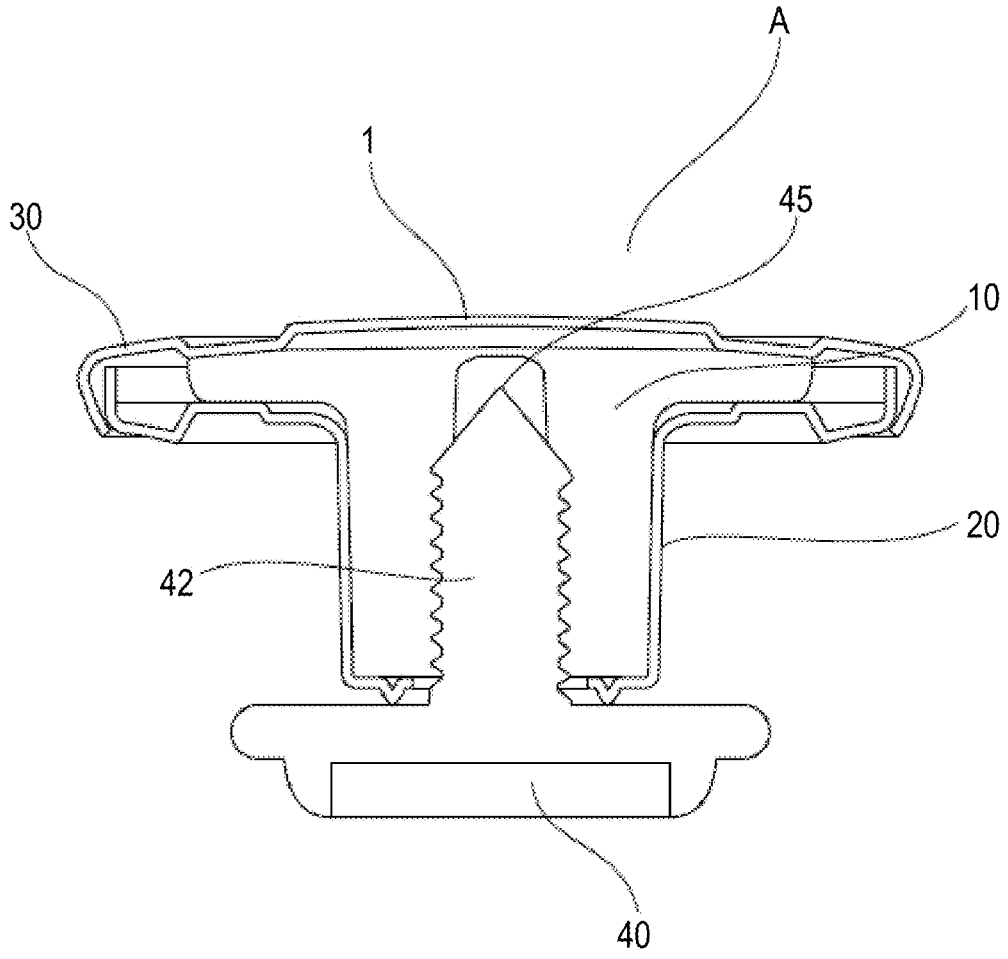
FIG. 7 is a sectional view of the button shown in FIGS. 1 to 3 assembled with the removable screw shown in FIGS. 5 and 6.
Figure 8:
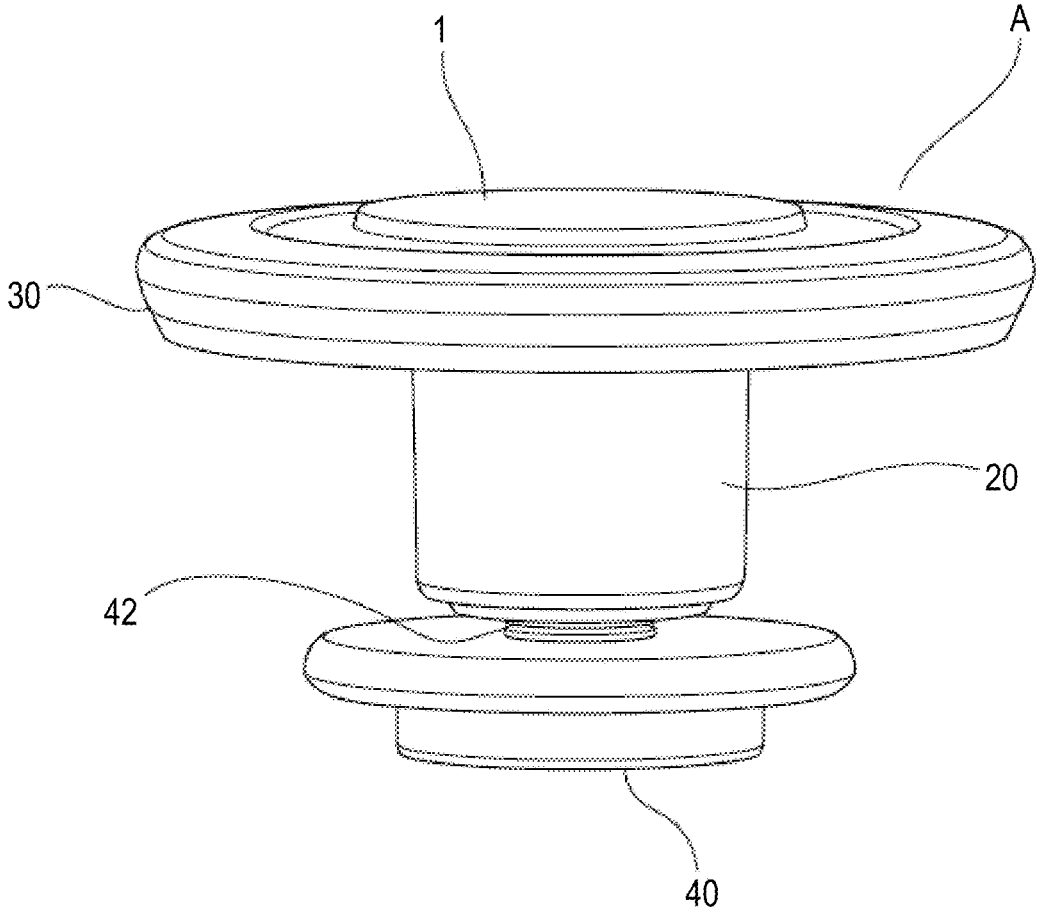
FIG. 8 is a perspective view of the button shown in FIGS. 1 to 3 assembled with the removable screw shown in FIGS. 5 and 6.
Figure 9:
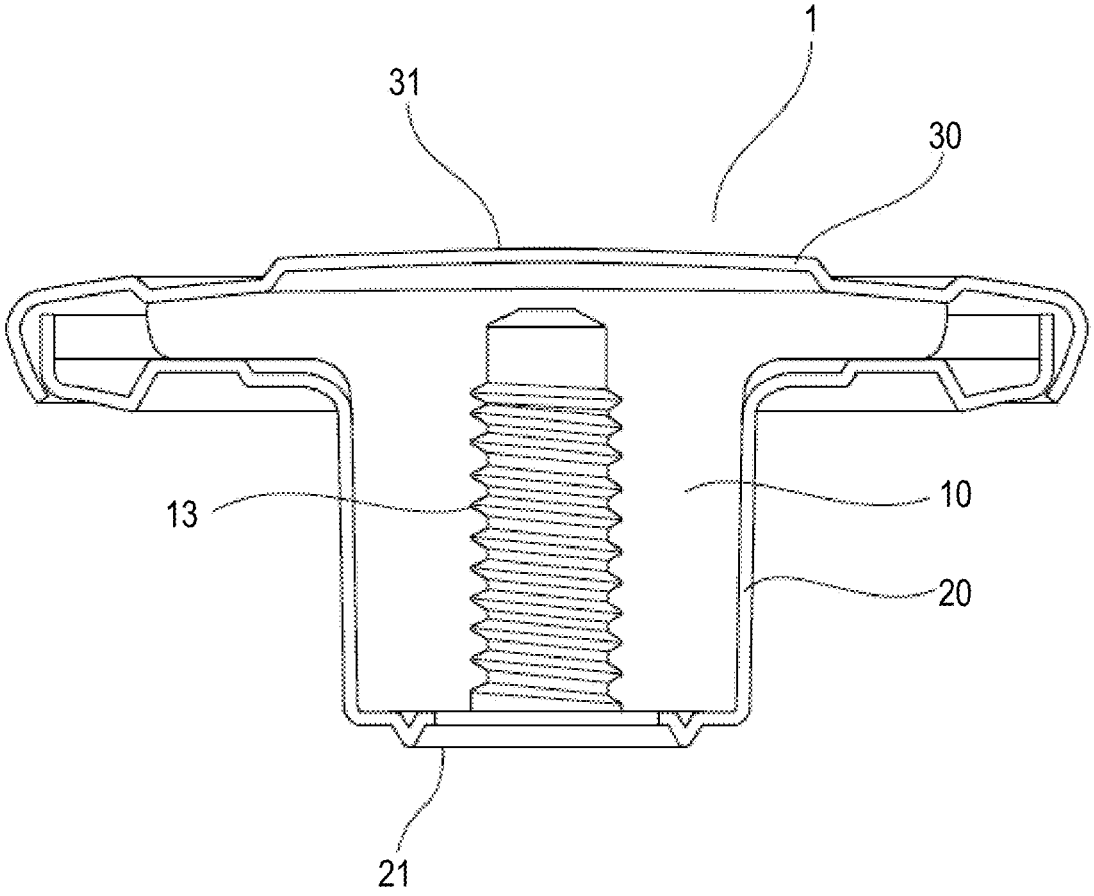
FIG. 9 is a sectional view of the button shown in FIGS. 1 to 3 after the removable screw shown in FIGS. 5 and 6 is removed from the button.

FIGS. 7 and 8 show the button 1 shown in FIGS. 1 to 3 assembled with the removable screw 40 shown in FIGS. 5 and 6. In a button and removable screw assembly A, the post portion 42 of the removable screw 40 is inserted into the opening 22 of the bottom surface 21 and received in the cavity 13 of the button 1 as shown in FIG. 7. In order to attach the button 1 to a garment, the garment is placed between the removable screw 40 and the button 1 having no convexo-concave surface on the inner wall that forms the cavity 13 into which the screw 40 is inserted. Then, the removable screw 40 is tucked into the cavity 13 of the button 1 from the bottom surface 21 of the button 1 through the garment at high speed. In some cases, the removable screw 40 may be rotated when the removable screw 40 is inserted into the cavity 13 of the button 1. However, it is preferable to tuck the screw 40 without rotating the screw 40 when the post portion 42 of the screw 40 is tucked into the cavity 13 of the button 1 since an attachment machine in the related art can be used as it is without reducing a yield. The sharp leading end 45 of the removable screw 40 facilitates the removable screw 40 to pass through the garment and the insert portion 10 of the button 1. When the post portion 42 of the removable screw 40 is tucked into the insert portion 10 of the button 1, the screw 40 is attached to the button 1. As shown in FIG. 9, convexo-concave surface corresponding to the shape of the screw threads 44 on the outer surface 43 of the post portion 42 of the screw 40 is formed at the inner wall that forms the cavity 13 of the button 1. When the cavity 13 formed in the post portion 12 of the button 1 has a cavity depth larger than a length of the post portion 42 of the screw 40, there is a region in the cavity 13 where the screw 40 is not inserted as shown in FIG. 7. In this region, convexo-concave surface is not formed on an inner wall of the post portion 12 where the cavity 13 is formed and the inner wall in this region is flat. This can be confirmed even after the screw 40 is removed from the button 1 as shown in FIG. 9. After the removable screw 40 is completely tucked into the cavity 13 of the button 1, the button 1 is securely attached to the garment. The button 1 can be removed from the garment by rotating the removable screw 40 along the convexo-concave surface formed at the insert portion 10 of the button 1.

Different arrangements may be made for the components shown in the drawings or described above, as well as components and steps not shown or described. Similarly, some features and subcombinations are useful and may be employed without reference to other features and sub combinations. Embodiments of the invention have been described as an example and are not intended to limit the present invention. Alternative embodiments will be apparent to readers of the present patent. Accordingly, the present invention is not limited to the embodiments described above or shown in the drawings, and various embodiments and modifications can be made.

According to the present invention, even when the button has no convexo-concave surface in the cavity into which the screw is inserted and the button is attached, convexo-concave surface corresponding to the screw threads at the outer surface of the post portion of the screw can be formed on an inner wall that forms the cavity of the button after the button is attached. The button and the screw can be removed from the fabric by rotating at least one of the button and the screw. Therefore, it is possible to facilitate recycling of a garment without using a cutting machine or a crusher.

What is claimed is:

1. A method of attaching a removal screw, the method comprising:

a first step of preparing a button that includes a plate portion and a post portion erecting from the plate portion of the button and has no convexo-concave surface in a cavity provided in the post portion of the button and preparing a screw that includes a plate portion and a post portion erecting from the plate portion of the screw and has screw threads on an outer surface of the post portion of the screw; and a second step of placing fabric between the button and the screw, tucking the post portion of the screw into the cavity of the button to allow the post portion of the screw to pass through the fabric, attaching the screw to the button, and forming the convexo-concave surface corresponding to a shape of the screw threads on the outer surface of the post portion of the screw in the cavity of the button, wherein, in the first step:

the button includes an insert portion and an outer portion;

the insert portion includes the plate portion of the button and the post portion of the button that are formed of a resin;

the outer portion covers an outer side of the insert portion and is formed of a metal; and the outer portion covers an entire side face of the insert portion and a bottom face of the insert portion.

2. The method of attaching a removal screw according to claim 1, wherein in the second step, when the post portion of the screw is tucked into the cavity of the button, the screw is pushed without being rotated.

3. The method of attaching a removal screw according to claim 1, wherein in the second step, after the screw is attached to the button, the button and the screw are removed from the fabric by rotating at least one of the button and the screw.

4. The method of attaching the removal screw according to claim 1, wherein in the first step, the post portion of the button is formed of a material softer than a material of the post portion of the screw.

5. The method of attaching the removal screw according to claim 1, wherein in the first step, the button includes a cap, and the cap covers the insert portion and the outer portion and is formed of a metal.

* * * * *